United States Patent [19]

Lockwood

[11] 4,334,560

[45] Jun. 15, 1982

[54] LOCKING BRACE FOR GASOLINE DISPENSING NOZZLES

[76] Inventor: Frank J. Lockwood, 7011 W. Archer Ave., Chicago, Ill. 60638

[21] Appl. No.: 914,733

[22] Filed: Jun. 12, 1978

[51] Int. Cl.[3] ..... B65B 3/04

[52] U.S. Cl. ..... 141/392; 141/DIG. 1

[58] Field of Search ..... 74/526; 141/1, 392, 141/DIG. 1, 206–210; 248/354 S; 251/90, 112

[56] References Cited

U.S. PATENT DOCUMENTS

| | | | |
|---|---|---|---|
| 2,251,087 | 7/1941 | Vincent | 74/526 |
| 2,397,516 | 4/1946 | Stewart | 74/526 X |
| 2,625,051 | 1/1953 | Kriseman | 74/526 X |
| 2,906,301 | 9/1959 | Mannon | 141/209 |
| 2,982,318 | 5/1961 | Ferreri | 141/392 X |
| 4,095,629 | 6/1978 | Jordan | 141/392 |

*Primary Examiner*—Frederick R. Schmidt

*Attorney, Agent, or Firm*—Wallenstein, Wagner, Hattis, Strampel & Aubel

[57] ABSTRACT

A portable brace adjustable in length for retaining the trigger lever of a fuel dispensing nozzle in the open position and capable of easily disengaging in response to the shutoff actuating means of the nozzle.

7 Claims, 4 Drawing Figures

FIG. 1
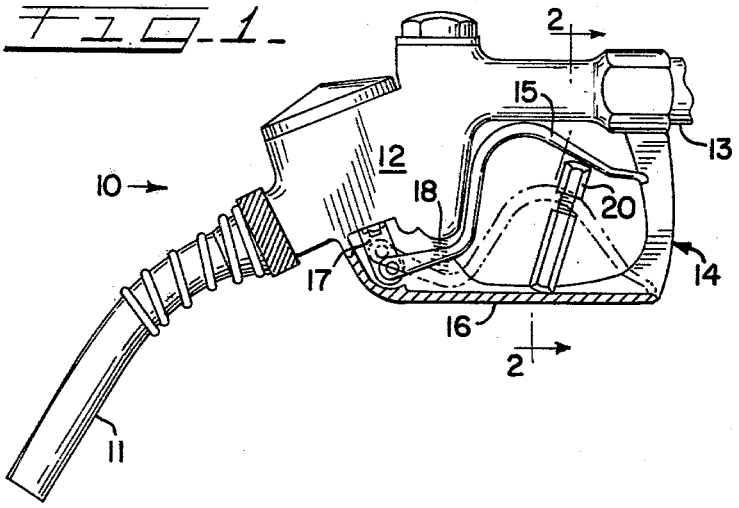
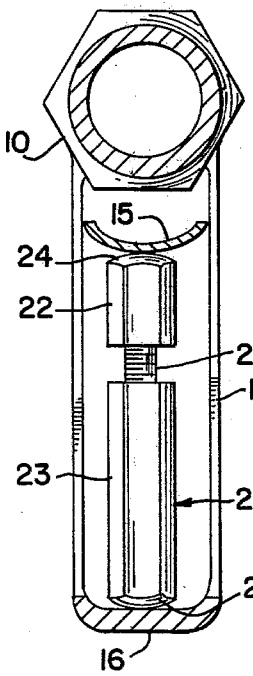
FIG. 2
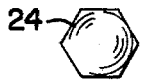
FIG. 3
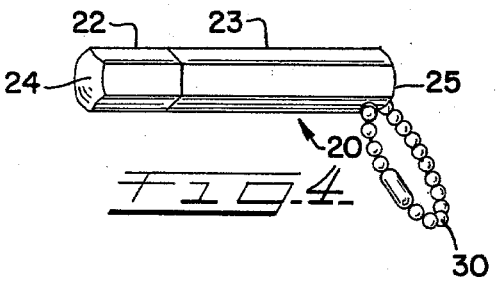
FIG. 4

LOCKING BRACE FOR GASOLINE DISPENSING NOZZLES

BACKGROUND OF THE INVENTION

The present invention relates to accessories for automatic fuel dispensing nozzles and, more particularly, to a means for retaining the nozzle in an open position in the filling operation normally required for properly filling a vehicle fuel tank.

With the recent popularity of self-service gasoline pumps at automobile service stations, self-service customers have found that frequently the pumps to which they are relegated have no latch or other restraining means attached to the handle by which the operating lever is retained in the open position. This is contrary to prior gasoline pumps where the automatic fuel dispensing gas nozzles at service stations, prior to the advent of the self-service stations, have included some form of a latch for engagement of the flow control lever for operation of the nozzle at different flow rates. The control member is generally pivotally mounted to the handle guard or frame. Variations of this type of latch may be found in U.S. Pat. Nos. 3,520,338; 3,586,069; 3,774,656; and, 3,273,609.

Due to the absence of these holding devices on self-service pumps, the constant presence of a self-service patron is required when filling the gas tank, thereby subjecting these patrons to inclement weather, cold nozzles and the like, which slows up the entire service station visit should one also wish to wash the car windows, check the oil and do other similar maintenance. The gasoline is generally pumped from underground tanks, so that the gasoline may be extremely cold in the winter, and, by making the nozzle assembly very cold, it becomes difficult to retain one's grip on the nozzle assembly for the extended period of time required to pump fifteen to twenty gallons of gas.

SUMMARY OF THE INVENTION

It is therefore an object of the subject invention to provide a new and improved portable locking brace means for retaining the trigger lever of an automatic fuel dispensing nozzle in the open position.

It is another object of the subject invention to provide a portable locking brace for retaining the trigger lever of an automatic fuel dispensing nozzle in an open position without operator attention whereby the open position may be varied to allow different flow rates of the fuel being dispensed.

Still another object of the subject invention is a portable locking brace for retaining the trigger lever of an automatic fuel dispensing nozzle in an open position which will automatically respond to the shutoff actuating means of the nozzle.

These and other objects of the subject invention are attained in accordance with the present invention wherein there is provided a cylinder variable in length having opposing spherical ends. In the preferred embodiment, the holding device comprises two components, one being threadedly engageable with the other to thereby enable the length of the overall cylinder to be varied and effect different flow rates as desired.

DESCRIPTION OF THE DRAWINGS

Further objects of the invention together with additional features contributing thereto and advantages accruing therefrom will be apparent from the following description of one embodiment of the invention when read in conjunction with the accompanying drawings, wherein:

FIG. 1 is a side view of a fuel dispensing nozzle showing the holding means of the subject invention in use;

FIG. 2 is a cross-sectional view taken along the line 2—2 of FIG. 1;

FIG. 3 is a top plan view of the subject invention; and,

FIG. 4 is a side elevational view of the subject invention in the closed position.

Referring now to FIG. 1, there is shown a gasoline dispensing nozzle 10 of the type in general use having a discharge end 11 for insertion into the fuel tank of the vehicle. At the opposite end, the nozzle 10 is connected to a hose or other flexible conduit 13 which itself is in communication with a larger fuel tank (not shown) which is normally underground. Through a pump means or the like, the fuel in the underground tank is forced or drawn through the hose 13 and into the nozzle assembly 10 for dispensing to the fuel tank of the vehicle. As the means of control of the fuel flow through the nozzle is not a part of the subject invention and many different devices may be used with the subject invention, the nozzle assembly 10 will only be described in general terms. The nozzle 10 itself comprises a valve means 12 which generally consists of a lock-out or dash pot assembly and a control valve (not shown). The handle or trigger lever 15 controls the flow of the fuel through the valve section 12 of the handle 10. Shown as supporting the trigger lever 15 in an open position is the brace, prop or strut means 20 of the subject invention. In the filling operation, the shutoff sequence commences when the fuel reaches a predetermined level in the tank, and a release plunger 17 is actuated by the dash pot assembly to lower the forward end of the handle lever 15 sufficiently to cause the control valve within the valve assembly 12 to return to the closed position and terminate the flow through the nozzle. This action also generally releases the trigger operating lever 15 to the position shown in dotted lines in FIG. 1. Thus, when the trigger lever 15 is held in the open position, the lock-out plunger 17 is extended and the tappet rod 18 is depressed, thereby allowing a flow of fuel through the nozzle assembly into the fuel tank. Upon sensing that the appropriate level in the fuel tank has been reached, the dash pot assembly draws the lock-out plunger 17 upward, allowing the spring loaded tappet rod to slide downward and close the control valve to stop the flow of fuel through the nozzle. The trigger lever 15 is retracted to the position shown in dotted lines by the force of the tappet rod. Other flow control means may be used, however, the above-described apparatus is the form in general current use.

In such gasoline nozzles in current use, the handle lever 15 is retained in the open position by a latch hingedly secured to the handle housing or guard 14 so that it can easily disengage the handle lever when the lock-out plunger 17 is drawn upward. The engagement of the hinged latch with the handle lever 15 must necessarily be rather sensitive to allow its easy disengagement in response to the slight movement of the handle lever 15 caused by the commencement of the shutoff sequence. Of course, other devices such as those hingedly connected to the trigger lever itself are in use; however, as already stated, these latches are generally not found on self-service gas pumps and, therefore, the consumer must be present at all times to manually engage the trigger lever 15 and control the flow of fuel into his vehicle fuel tank.

The brace of the subject invention shown in use in FIG. 1 is manually insertable between the trigger lever 15 and the trigger guard or housing 14 so that it may retain the trigger lever 15 in an open position. The subject invention generally comprises a portable adjustable brace 20 which, in the embodiment shown in the drawings, is an elongated hexagonal cylindrical device having two separable portions and formed of a non-sparking metal such as stainless steel. A hard rigid plastic material insoluble in gasoline, similar vehicle fuels, and other hydrocarbons would also be appropriate. The brace 20 is wedged or biased against the underside of the trigger 15 and the lower trigger frame member 16, thereby retaining the trigger lever 15 in the open position.

As shown in FIG. 2, the subject invention comprises an upper portion 22 and a lower portion 23. Although the upper portion 22 is depicted as being of generally smaller length than the lower portion 23, each portion may be equal in length to the other. While one portion is arbitrarily denominated upper and the other lower, it can be readily seen that turning the brace of the subject invention upside down merely reverses these arbitrary terminologies.

Fixedly secured in the upper portion 22 is a threaded segment 21. This threaded segment is received into a mating nut or threaded region within the lower portion 23. Thus, the upper portion 22 may incrementally adjust the length of the entire brace by the rotation of one portion relative to the other. This incremental adjustment feature permits a user to adjust and lock the rate of flow of the fuel through the nozzle assembly to practically an infinite number of fuel dispensing rates.

The opposing and nonadjacent ends 24 and 25 of the brace 20 of the subject invention are rounded, thereby providing a spherical end to each of these opposing ends 24 and 25. These spherical or rounded ends provide the needed responsiveness to the brace 20 of the subject invention for assuring that it will automatically and quickly disengage from the trigger 15 in response to the actuation of the lock-out plunger 17 by the dash pot assembly in the shutoff sequence.

While the brace shown in the drawings is of a hexagonal shape, any polygonal shape will suffice. Indeed, the brace 20 would function in an acceptable manner if the brace were generally cylindrical in shape. However, the hexagonal shape has been found to be optimal, allowing one hand to easily rotate one portion while holding the other portion. Such a feature becomes extremely important in cold weather when attempting to adjust the length of the brace with cold fingers or with heavy gloves on. In fact, the hexagonal shape allows the easy one-handed adjustment of the brace length while holding the trigger 15 in the open flow position. In this manner, the exact flow rate desired can be easily reached with no guesswork.

Securing a small chain 30 through one end of the brace 20 allows it to be used as a keychain and, thus, always available for use in refueling the vehicle. In fact, an enterprising service station manager might secure it by such a chain 30 or the like to the nozzle assembly so that a nozzle without the integral hinged latch might be converted to a nozzle with a trigger retaining means through the use of the subject inventive brace. The small size of the brace 30 and its relatively inexpensive manufacturing costs makes it an attractive promotional object to be given away as a courtesy to one's customers.

In addition, the brace 20 might incorporate a magnet. Should the brace be molded of a hard plastic, the plastic could easily be molded about a bar magnet on one or both sides. With such a magnet the brace 20 of the subject invention could be stored on any metal portion of the vehicle for easy accessibility at all times.

Upon a consideration of the foregoing, it will become obvious to those skilled in the art that various modifications may be made without departing from the invention embodied herein. Therefore, only such limitations should be imposed as are indicated by the spirit and scope of the appended claims.

I claim:

1. An adjustable and portable prop means to be carried by a user for use with a fuel dispensing nozzle, said nozzle having a nozzle lever and lever guard, said nozzle lever being movable from a normally closed position to an open position for dispensing fuel, said portable prop means allowing the automatic control of the fuel-flow rate and the automatic and precise shut-off of the nozzle to thereby allow the unattended filling of a fuel tank and assure the automatic shut-off of said fuel flow without spillage when said fuel tank is full, said portable prop means being capable of insertion between said nozzle lever and said lever guard of said nozzle for exerting a continuous force against each of said nozzle lever and said lever guard in said open position, said portable prop means comprising opposing first and second portions of a non-sparking material, said first and second portions being connected by an adjusting means for varying the length of said portable prop means from a fully extended first position to a closed second position, and retaining said portable prop means at a desired length, opposing ends of said prop means being rounded to form a spherical segment to make said prop means responsive for precise shut-off of said fuel flow by automatic disengagement from said nozzle lever and said lever guard, whereby the fuel-flow rate of said nozzle may be controlled by biasing said opposing rounded ends of said portable prop means against each of said portable prop means being preadjusted to a desired length for effecting a desired flow rate, said flow rate being automatically shut-off by the response of said nozzle to the filling of the fuel tank.

2. The combination of claim 1 wherein said prop means comprises a generally elongated cylindrical object of a polygonal cross section.

3. The combination of claim 2 wherein said prop means is of a hexagonal cross section.

4. The combination of claim 1 wherein said first portion is threadedly secured to said second portion.

5. The combination of claim 1 wherein said prop means incorporates a magnet.

6. The prop means of claim 1 wherein each of said portions is formed from nonsparking stainless steel.

7. The prop means of claim 1 wherein each of said portions is formed from a hard plastic material, said hard plastic material being insoluble in hydrocarbon solvents such as gasoline.

* * * * *